US010995546B2

(12) United States Patent
Seuberling et al.

(10) Patent No.: US 10,995,546 B2
(45) **Date of Patent: *May 4, 2021**

(54) HIDDEN FASTENER WINDOW SCREEN INSTALLATION SYSTEM

(71) Applicant: Home Improvement Systems, Inc., Cincinnati, OH (US)

(72) Inventors: David Seuberling, Cincinnati, OH (US); William F Browning, Milford, OH (US)

(73) Assignee: HOME IMPROVEMENT SYSTEMS, INC., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/742,069

(22) Filed: Jan. 14, 2020

(65) Prior Publication Data

US 2020/0173230 A1 Jun. 4, 2020

Related U.S. Application Data

(63) Continuation-in-part of application No. 15/652,449, filed on Jul. 18, 2017, now Pat. No. 10,577,860.

(51) Int. Cl.
*E06B 9/52* (2006.01)

(52) U.S. Cl.
CPC ..... *E06B 9/52* (2013.01); *E06B 2009/527* (2013.01)

(58) Field of Classification Search
CPC ..... E06B 2009/527; E06B 9/52; E06B 9/521; E04B 9/30; E04B 9/303; B65D 21/086; B65D 31/18; B65D 5/2028; B65D 5/2042
USPC ..... 160/380, 395
See application file for complete search history.

(56) References Cited

U.S. PATENT DOCUMENTS

| | | | | | |
|---|---|---|---|---|---|
| 918,676 | A | | 4/1909 | Johnson | |
| 1,586,708 | A | | 6/1926 | Sandelin | |
| 2,568,139 | A | | 9/1949 | Behnke | |
| 2,709,489 | A | * | 5/1955 | Keebler | E06B 9/52 160/381 |
| 3,058,518 | A | * | 10/1962 | Housman | E06B 3/285 160/380 |
| 3,220,469 | A | * | 11/1965 | Oehmig | E06B 9/52 160/380 |
| 3,469,695 | A | | 9/1969 | Greeninger | |
| 3,696,857 | A | | 10/1972 | Le Tarte | |
| 3,960,197 | A | * | 6/1976 | Daniels | A47G 1/0605 160/371 |
| 3,980,555 | A | | 9/1976 | Freissle | |

(Continued)

*Primary Examiner* — Brent W Herring
(74) *Attorney, Agent, or Firm* — Indiano Law Group, LLC

(57) ABSTRACT

A hidden fastener screen installation system includes a plurality of screen frame extrusions cooperating to form an opening across which a screen is positioned. Each screen frame extrusion includes a mounting surface and a singular mounting rib extending outwardly from the mounting surface. The mounting surface is configured to receive a plurality of mechanical fasteners to retain the screen frame extrusion to a portion of a building structure. A trim mold includes a channel configured to closely receive and retain the mounting rib. The screen is received in the channel and is retained by cooperation between the trim mold and the mounting rib. A portion of the trim mold extends over the fasteners and fully covers the fasteners such that the fasteners are completely hidden upon installation of the trim mold on the screen frame.

19 Claims, 6 Drawing Sheets

(56) References Cited

U.S. PATENT DOCUMENTS 4,189,880 A 2/1980 Ballin
4,233,790 A * 11/1980 Meadows ..... E06B 3/285 160/395
4,234,035 A 11/1980 Babbs
4,333,284 A * 6/1982 Meadows ..... E06B 3/7001 160/179
4,410,027 A 10/1983 Lucous
4,658,522 A 4/1987 Kramer
4,690,192 A 9/1987 Stilling
4,733,510 A * 3/1988 Werner ..... E06B 3/28 428/34
4,899,797 A * 2/1990 Green ..... E06B 9/52 160/380
5,086,604 A * 2/1992 Orth ..... E06B 3/28 52/202
5,143,138 A * 9/1992 Zwart ..... E06B 9/521 160/369
5,253,457 A * 10/1993 Orth ..... E06B 3/28 49/62
5,301,737 A 4/1994 Martin
5,586,400 A * 12/1996 Moore, III ..... D05C 9/04 112/103
5,613,544 A 3/1997 Schaefer
5,666,773 A 9/1997 Librande
5,904,200 A 5/1999 Agen
6,032,433 A 3/2000 Hatziathanasiou
6,378,267 B1 * 4/2002 Bass ..... E06B 9/52 160/57
7,938,163 B2 * 5/2011 Caruso ..... E06B 3/08 160/392
7,939,163 B2 5/2011 Caruso
8,789,694 B2 * 7/2014 Roesler ..... B65D 21/086 206/349
9,353,567 B2 * 5/2016 Pardue ..... E06B 7/2318
9,487,999 B2 * 11/2016 Seuberling ..... E04H 1/1205
9,518,423 B2 * 12/2016 Seuberling ..... E06B 9/52
9,630,744 B2 * 4/2017 Sohler ..... B65D 21/00
2008/0179323 A1 * 7/2008 Circosta ..... A45D 44/18 220/8
2013/0062234 A1 * 3/2013 Roesler ..... B65D 21/086 206/349
2013/0334220 A1 * 12/2013 Sohler ..... B65D 21/00 220/4.03
2019/0110879 A1 * 4/2019 Camp ..... A61M 25/002

* cited by examiner

HIDDEN FASTENER WINDOW SCREEN INSTALLATION SYSTEM

CROSS REFERENCE TO RELATED APPLICATIONS

The present application is a continuation-in-part of U.S. patent application Ser. No. 15/652,449 filed Jul. 18, 2017 the entirety of which is incorporated herein by reference.

BACKGROUND

Most screens presently include a replaceable screen fabric. In the event the fabric is torn, stretched, or otherwise damaged, the fabric can be removed and replaced with another such fabric. A window screen installation system which permits the replacement of the screen is taught in U.S. Pat. No. 6,378,267 to Bass, the teachings of which are incorporated herein by reference.

FIG. 1 is an illustration of a window screen installation system embodying the teachings of the prior art, specifically of the '276 Patent to Bass. This window screen installation system 100 includes a screen frame 112 which is mounted to a window frame 104 through a plurality of fasteners 102. The fasteners 102 attach the screen frame 112 to an inner perimeter of a window frame 104. A mounting rib (not shown) extends outward from the screen frame 112, A trim mold 114 includes a channel opening on the bottom surface thereof structured to receive and retain the mounting rib therein. A screen 16 is retained between the trim mold 114 and a mounting rib of the screen frame 112, such that the screen is deformed over the mounting rib, and the mounting rib and the screen are both received within the trim mold channel.

As can be readily seen in FIG. 1, prior art screen replacement systems often include a plurality of visible fasteners 102. The use of mechanical fasteners, such as screws, provides for a stronger attachment between the window frame and the screen installation system than can be achieved with systems which utilize frictional fittings or adhesives, Although the use of mechanical fasteners is desirable to retain a screen retention frame to a window frame, many architects find exposed fasteners to be unpleasant. In fact, many architects will not employ systems in which exposed fasteners are present.

Additionally, screen systems of the prior art include complex multi-rib arrangements, as taught by U.S. Pat. No. 3,220,469 to Oehmig. Such multi-rib systems are expensive to manufacture, and are complicated to install. Moreover, such multi-rib systems can fail (e.g. cannot be correctly fastened) due to debris accumulation between the rib channels. Such debris accumulation can prevent the trim mold from properly attaching to the ribs. Therefore, further technological developments are desirable in this area.

SUMMARY

One embodiment of the present application includes a hidden fastener window screen installation system. Other embodiments include unique hidden fastener window screen installation apparatuses, systems, and methods. Further embodiments, inventions, forms, objects, features, advantages, aspects, and benefits of the present application are otherwise set forth or become apparent from the description and drawings included herein.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
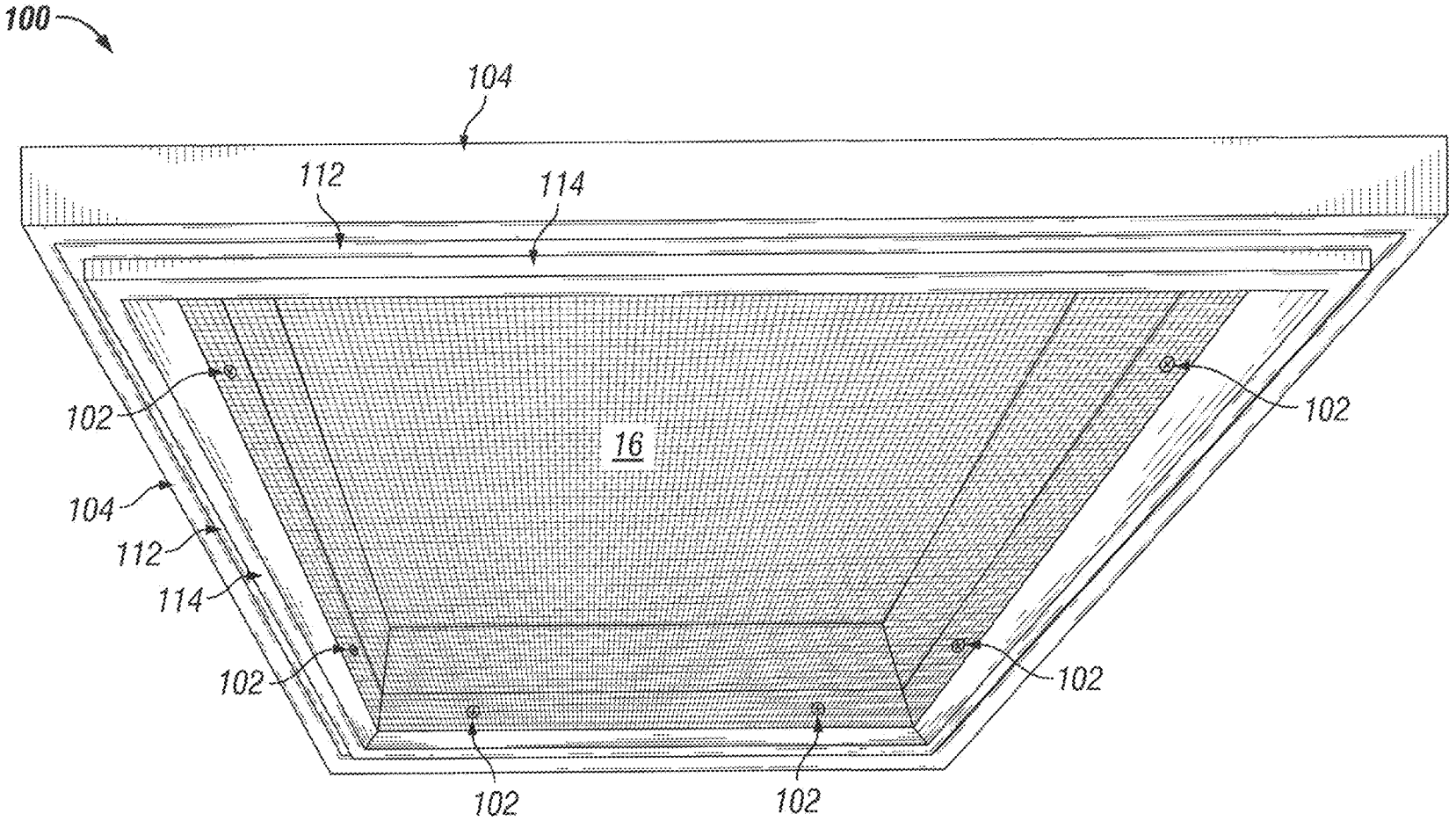
FIG. 1 (Prior Art)
FIG. 1 depicts a window screen installation system embodying the teachings of the prior art.

For purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 2:
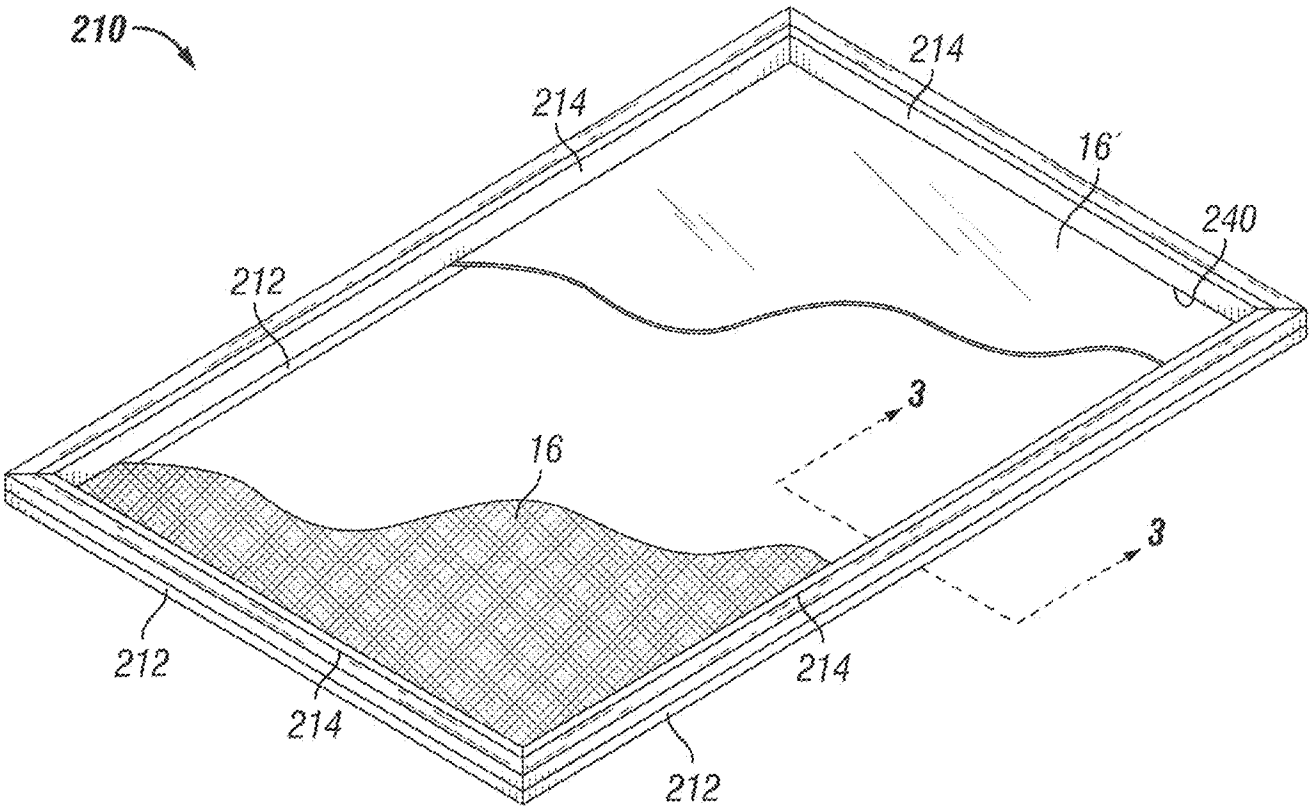
FIG. 2 is a perspective view of the hidden fastener window screen installation system constructed in accordance with several features of the present application.

FIG. 2 is a perspective view of a hidden fastener screen frame installation system 210 of the present application. The window screen installation system 210 includes a plurality of screen frames 212 which define an opening 240 across which is suspended a screen fabric 16 or other pliable sheet material 16'. The cooperation between the screen frames 212 and trim molds 214 permit the releasable mounting of a screen fabric 16 in such a manner as to self-tighten the fabric 16 during installation. A rubber mallet, or other suitable tools), can be utilized to expedite the installation of the trim molds 214 to the screen frames 212. In removing the trim mold 214 from the screen frame 212, a screwdriver, or other suitable prying implement can be utilized to aid a user in the removal. However, it is contemplated that the trim mold 214 can be snapped on the screen frame 212, or removed from the screen frame 212 absent any tools. Moreover, the screen frames 212 and trim molds 214 are designed to allow for the mounting of the screen 16 without damaging the screen 16 such that it may be removed and reused as required.

As will be discussed at depth hereinafter, the screen frame 212 is mounted near an opening of a structure via a plurality of mechanical fasteners. These mechanical fasteners extend through a mounting surface of the screen frame 212 and into a building structure providing a resilient attachment of the screen frame 212 to the structure. Although it is contemplated that the screen frames 212 can be mounted to various locations on the structure, some exemplary mounting locations include screen porch panels (as may be utilized to construct a screened in porch), window frames, door frames, or any other suitable location where a screen 16 is desired.

The trim mold 214 is configured such that it will cover, and thereby hide, the heads of fasteners when the trim mold 214 is secured to the screen frame 212. Therefore, after installation of the trim mold 214 on the screen frame 212, the mechanical fasteners are no longer exposed providing a "clean" appearance to the screen frame installation system 210. In this manner, the present screen frame installation system 210 is aesthetically pleasing, yet includes sturdy hidden mechanical connections.

A screen 16 may be installed for use in such applications as a storm door or a window screen, or for larger applications such as screened-in porches. However, in colder seasons, it may be preferable to replace the screen 16 with a transparent sheet material 16' such as vinyl. Accordingly, the present invention is designed to allow for the replacement of the screen 16 with the sheet material 16', and vice versa. For ease of description, use of the term "screen 16" is intended to include a conventional screen 16, a conventional transparent sheet material 16', or any other pliable sheet that may be used as a membrane in the screen frame 212 of the present invention.

Figure 3:
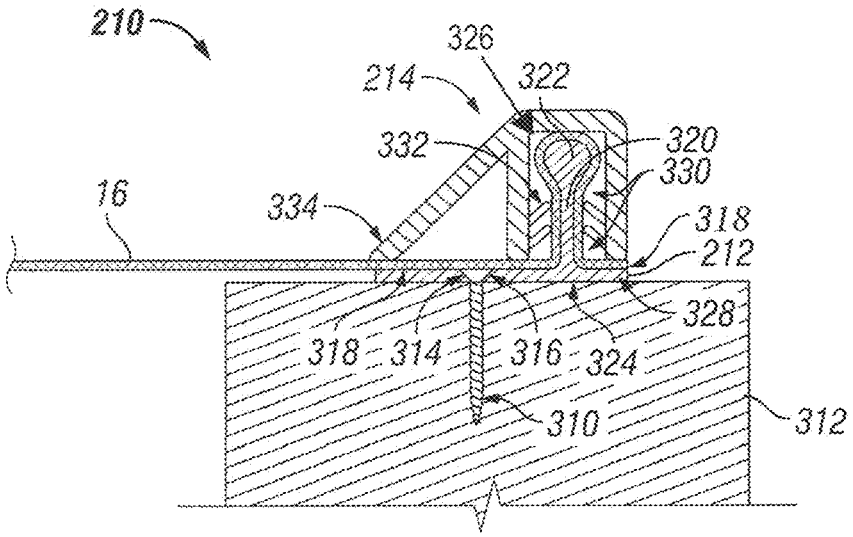
FIG. 3 is a cross-sectional view of the hidden fastener window screen installation system taken at 3-3 of FIG. 2.

As is illustrated in FIG. 3, the screen 16 is held securely in place between the screen frame 212 and the trim mold 214. The screen frame 212 and trim mold 214 can each be formed through an extrusion process. The trim mold 214 is configured to receive and be retained upon the screen frame 212. The screen frame 212 includes a mounting surface 318 and a mounting rib 320 which extends outward from the mounting surface 318. The mounting surface 318 is illustrated as comprising a generally rectangular shape. A lower surface 324 of the screen frame 212 is configured to abut against a surface of the structure 312.

The mounting rib 320 extends outwardly in a substantially perpendicular manner relative the mounting surface 318. The mounting rib 320 and the mounting surface 318 are integrally extruded in a manner such that the mounting rib 320 extends along a length of the mounting surface 318. A bead 322 is defined at the terminus 326 of the mounting rib 320 to serve as a locking mechanism to retain the mounting rib 320 within the trim mold 214. In one form, the screen frame is substantially T-shaped; however, various designs, including an L-shaped configuration are contemplated herein.

As illustrated, the mounting rib 320 is the only protrusion which extends outwardly from the mounting surface 318. It has been discovered that such a single mounting rib 320 design provides for ease of manufacture and simplicity of installation. Moreover, such a singular mounting rib 320 configuration fails to provide any cavities which would be prone to debris accumulation from the environment.

The lower surface 324 of the screen frame 212 is attached to the building structure 312 near an opening of the structure (not shown) such that the screen 16 can be suspended across the opening in the structure. The mounting surface 318 is configured to receive a plurality of fasteners 310. Fasteners 310 extend through the mounting surface 318, through the lower surface 324, and into the structure 312 thereby retaining the screen frame 212 to the structure 312 in a sturdy, semi-permanent manner. The mounting surface 318 can include a plurality of apertures 316 which are designed to receive the plurality of fasteners 310. Each aperture 316 can include a taper configured to receive a head 314 of a fastener 310, such that the head of the fastener 310 is substantially flush with the mounting surface 318, Although the fastener 310 is depicted as a screw type fastener, it is contemplated that a variety of mechanical fasteners including, but not limited to, screws, bolts, nails, or the like, can be utilized to attach the mounting surface 318 to the structure 312 in a semi-permanent manner. The mounting rib bead 322 and the fasteners 310 do not penetrate the screen 16, thereby permitting the screen or fabric 16 to be removed and reused as desired.

The trim mold 214 is configured to closely receive the mounting rib 320 of the screen frame extrusion 212. To this extent, the trim mold 214 defines a channel 330, and the channel 330 extends into the trim mold 214. In a preferred form, the channel 330 extends to a depth substantially equal to the height of the mounting rib 320 such that the trim mold 214 is snugly held against the mounting surface 318. The channel 330 can include a plurality of retention barbs 332, depicted as being disposed at an upward angle with respect to the mounting rib 320, to engage the mounting rib bead 322 in order to prevent inadvertent removal of the trim mold 214 from the mounting rib 320. In a preferred form, a height of the mounting rib 320 and bead 322, and the depth of the channel 330 are substantially equal.

The trim mold 214 includes an extension 334 which is designed to extend over and hide the fastener 310. As the extension 334 covers the fastener 310, the fastener 310 is not visible when the trim mold 214 is installed on the screen frame 212. This permits a "clean" installation free from visible mechanical fasteners, yet provides the structural integrity provided by the mechanical fastening of the screen frame 212 to the structure 312. In one form, the trim mold 214 includes a width substantially equal to a width of the mounting surface 318. In this form, when the trim mold 214 is installed over the mounting surface 318, the mounting surface 318 is substantially hidden by the trim mold 214.

Figure 4:
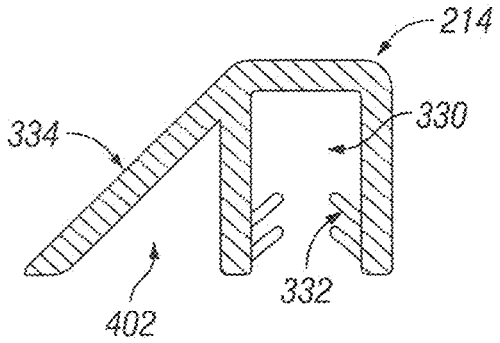
FIG. 4 depicts a cross-sectional view of a trim mold which retains a screen frame to a building structure, according to one form of the present application.
Figure 5:
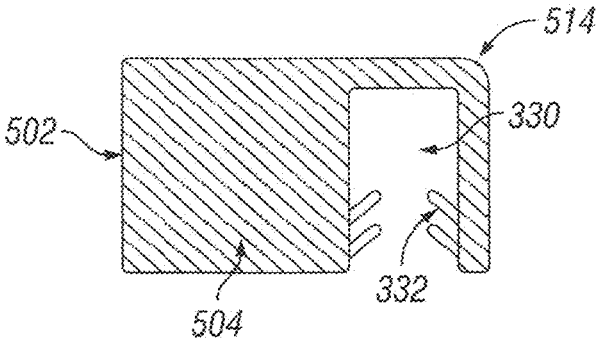
FIG. 5 depicts a cross-sectional view of an alternate embodiment of a trim mold.
Figure 6:
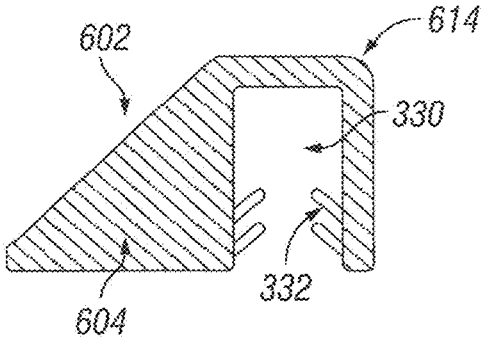
FIG. 6 depicts a cross-sectional view of a further alternate embodiment of a trim mold.

FIGS. 4-6 depict alternative embodiments of the trim mold 214, 514, and 614. As is illustrated in FIG. 4, the trim mold 214 can include a tapered extension 334 which extends outwardly toward a first end (opposite end 328) of the mounting surface 318. This tapered extension 334 is configured to cover the head 314 of the fastener 310 thereby concealing the head 314 of the fastener 310. The tapered extension 334 can include a hollow cavity 402 which rests above the fastener 310. The use of such a hollow cavity 402 and a taper 334 reduces the amount of material utilized in the extrusion of the trim mold 214. Furthermore, the taper 334 can add an aesthetically pleasing aspect to the trim mold 214.

FIG. 5 discloses an alternative embodiment of a trim mold 514. This trim mold 514 is substantially rectangular in shape 502. The extension 504 of the trim mold 514 which covers the fastener 310 is depicted as being solid. FIG. 6 discloses yet a further alternative embodiment of a trim mold 614. Trim mold 614 includes a tapered extension 602, similar to tapered extension 334; however, the tapered extension 602 is solid 604 (does not contain hollow cavity 402). Although trim molds 214, 514, and 614 have been described in detail herein, it is contemplated that a wide variety of trim mold designs may be utilized which receive and are retained to the mounting rib 320 and cover the fasteners 310 such that upon the installation of the trim molds no fasteners 310 are exposed.

In a preferred form, the screen frame 212 and the trim mold 214 are extruded and have a uniform cross-sectional profile. The screen frame 212 and the trim mold 214 can be extruded from various materials including, but not limited to, metals, polymers, or the like. In one specific form, the screen frame 212 is formed of extruded aluminum and the trim mold 214 is formed of an extruded polymer.

The installation process for the hidden window screen installation system 210 is described as follows. A plurality of screen frame extrusions 212 are cut and arranged to define the opening 240 across which a screen 16 or fabric is to be placed. A plurality of fasteners 310 are driven through a mounting surface 318 of the screen frame extrusions 212 and into the structure 312, thereby retaining the screen frame extrusions 212 to the structure 312.

The screen 16 is depressed over the screen frame extrusion 212 at approximately the point to be attached. The trim mold 214 is then oriented upon the screen frame extrusion 212 such that the trim mold 214 will cover the fasteners 310 of the respective screen frame extrusion 212. Upon alignment of the trim mold 214 and the mounting rib 320 of the screen frame extrusion 212, the trim mold 214 is pressed toward the screen frame extrusion 212 such that the screen 16 is deformed over the mounting rib 320 and the mounting rib 320 and screen 16 are both received within the trim mold channel 330. The screen 16 is thus tightly received between the mounting rib 320 and the channel 330, with the retention barbs 332 assisting in the retention thereof. The fasteners 310 are now hidden from view by the trim mold 214.

To remove slack within the screen 16, it is preferable to attach trim molds 214 to opposing sides in an alternating fashion (e.g. attaching the top trim mold 214 over the top screen frame extrusion 212 and retaining the screen 16 therebetween, pulling the screen 16 tight over the bottom screen frame extrusion 212 and attaching the bottom trim mold 214 to retain the screen therebetween, then proceeding to the left and right sides). The amount of slack removed from each side of the screen 16 is substantially equal to a height of the mounting rib 320. Any excess screen 16 can be trimmed from an exterior perimeter of the trim mold 214. Although the screen frame extrusions 212 have been depicted as defining a substantially rectangular opening 240, it is contemplated that the screen frame extrusions 212 can be constructed to define a variety of opening 240 shapes and sizes including, but not limited to, octagons, squares, and archways.

To remove the screen 16, the trim mold 214 is simply pried away from the screen frame extrusion 212 with, for example, a flat head screwdriver. Thus, mounting and removal of the screen 16 typically does not damage the screen 16, as the mounting rib 320 and fasteners 310 do not penetrate the screen 16.

Figure 7:
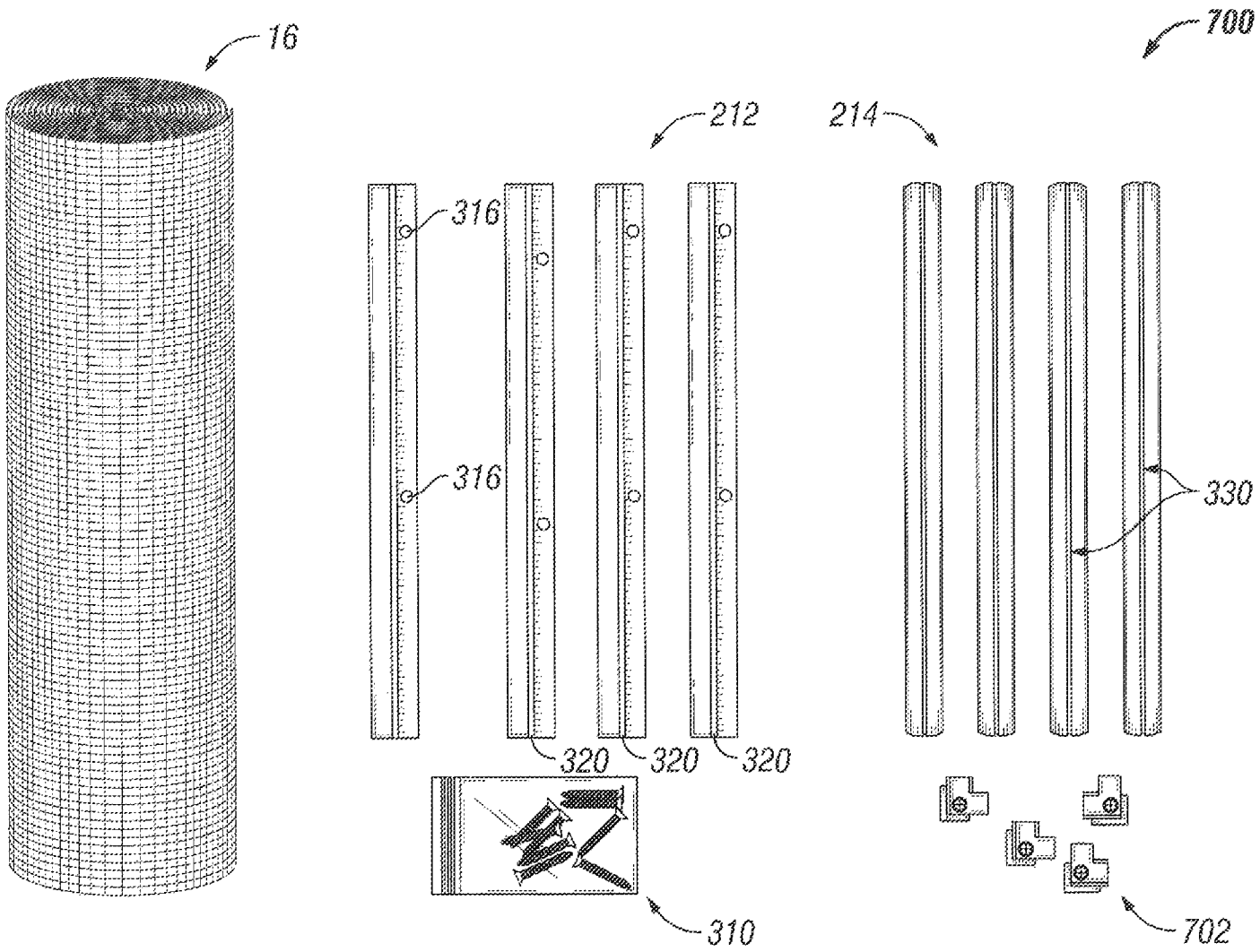
FIG. 7 depicts one form of a hidden fastener screen installation kit embodying the teachings of the present application.

Referring now to FIG. 7, one form of a hidden fastener screen installation kit 700 will now be described. As illustrated, the kit 700 includes a plurality of screen frame extrusions 212, as have been previously described herein. These screen frame extrusions 212 each include a mounting rib 320 and a plurality of apertures 316. This installation kit 700 includes a plurality of fasteners 310, depicted as a plurality of wood screws 310, which are configured to extend through the plurality of apertures 316 to retain the screen frame extrusions 212 into the structure (not shown).

A screen mesh 16, as was previously described, can be provided in the screen installation kit 700. As illustrated, the screen mesh 16 can take the form of a roll of screen mesh 16. The installation kit 700 includes a plurality of trim molds 214, as were previously described. Each trim mold 214 is depicted as including a channel 330.

While the installation kit 700 is depicted as including four (4) screen frame extrusions 212, and five (5) trim molds, it is contemplated that the kit 700 can include various lengths of extrusions 212 and molds 214, as well as various numbers of extrusions 212 and molds 214, depending upon the specific application. In one form, it is contemplated that the screen installation kit 700 is configured for installation of screen mesh 16 onto a singular opening. However, in further forms, the screen installation kit 700 can be configured for multiple openings, or to enclose an entire area (e.g. a gazebo kit).

The screen installation kit 700 can include a plurality of corner plinths 702. These corner plinths 702 are configured to abut against the ends two extrusions 212 and trim molds 214, thereby forming a corner. Once the trim molds 214 have been installed on the screen frame extrusions 212, and the screen 16 is retained therebetween, the corner plinths 702 can be fastened into the structure (e.g. via a plurality of wood screws). In some forms, a portion of the corner plinth 702 extends over the upper portion of the trim mold 214, such that any cut edge of the trim mold 214 is covered by the corner plinth 702. While the extrusions 212 and molds 214 can be cut to form miter joints at corners, the corner plinths 702 can provide a "finished" look to the corners.

The screen installation kit 700 can include an instruction manual (not shown) providing instructions on how to install the screen installation kit 700, as has been previously described herein.

Figure 8:
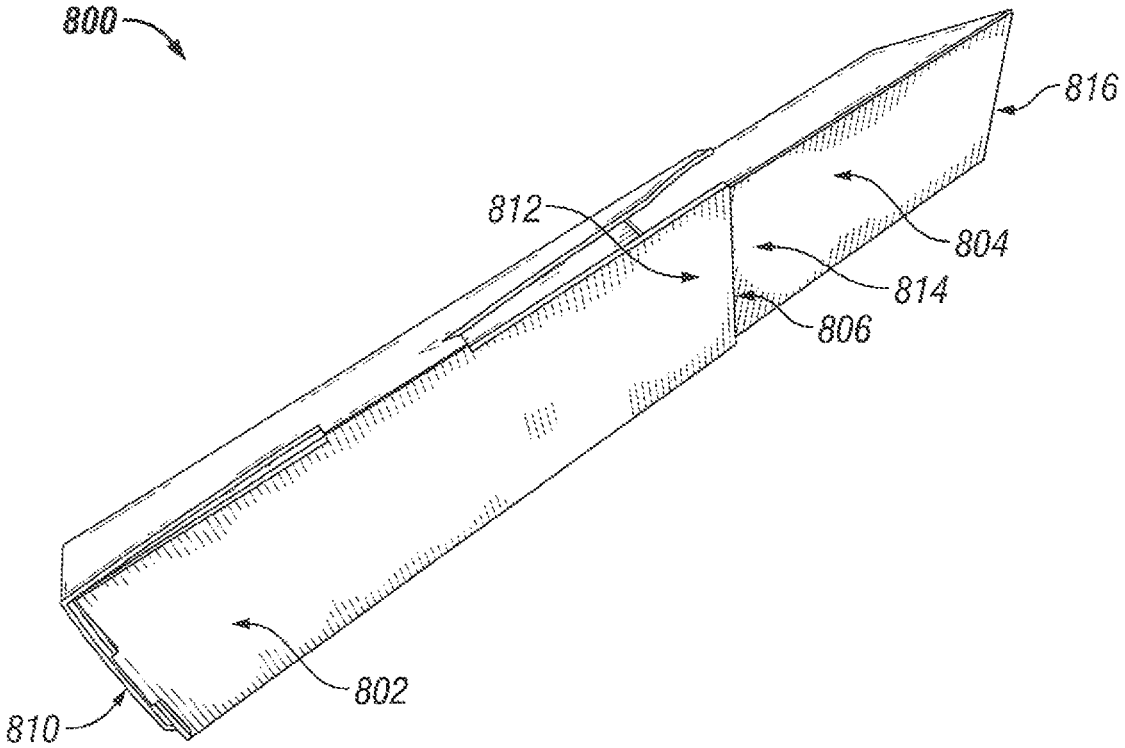
FIG. 8 depicts a telescoping shipping container, as can be utilized to ship a hidden fastener screen installation kit, according to one form of the present application.
Figure 9:
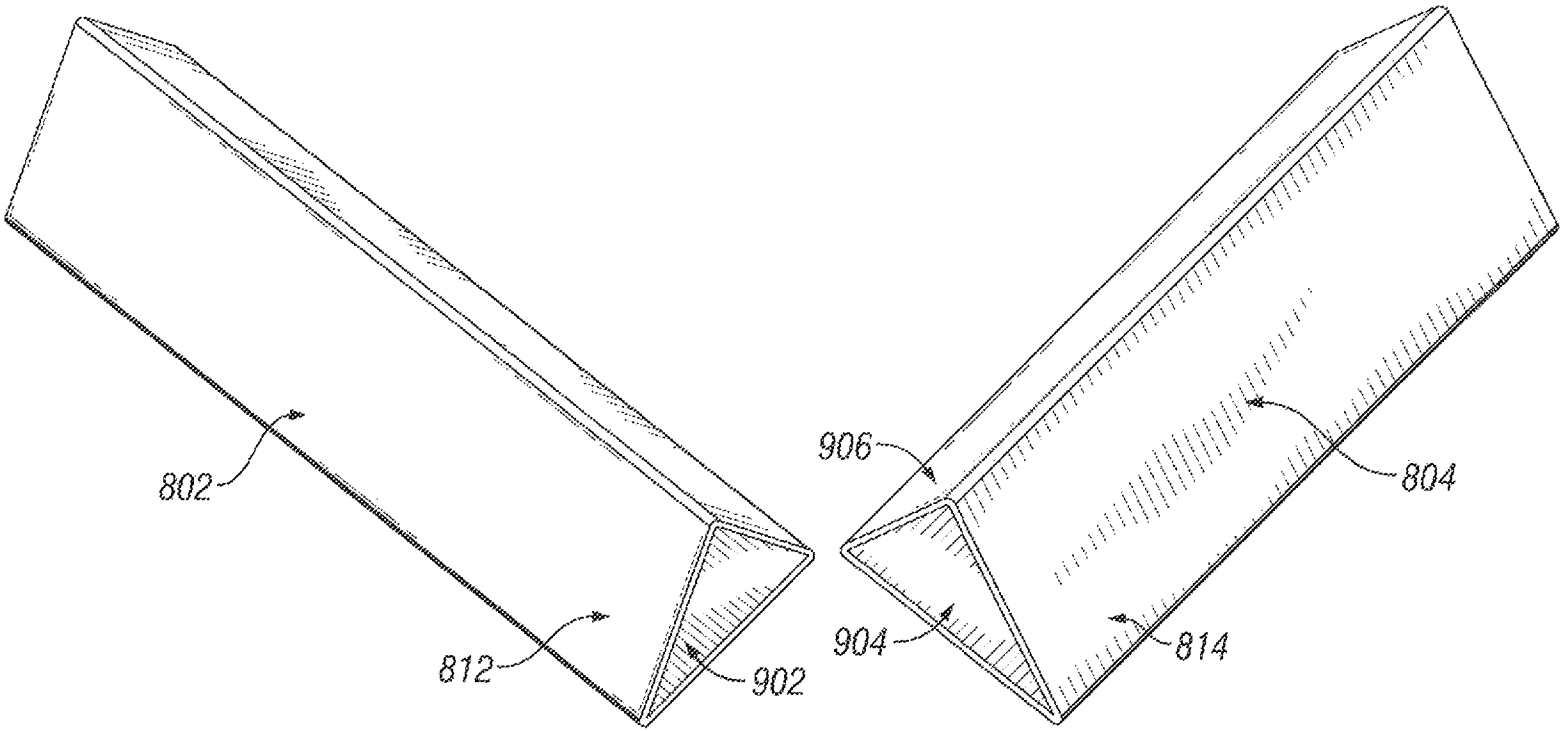
FIG. 9 depicts the telescoping shipping container of FIG. 8 in a separated state.

Referring now to FIGS. 8-9, the screen installation kit 700 can be shipped in a telescoping container 800. It has been discovered that such a telescoping container 800 is advantageous in that it can be adjusted to house a variety of lengths of screen frame extrusions 212 and trim molds 214. This has been found to be especially advantageous in reducing shipping costs (e.g. only shipping a container of the length required, and being able to adjust to the smallest size to house the screen frame extrusions 212 and trim molds 214 for a specific application).

This exemplary telescoping container 800 is depicted as having a first portion 802 including a closed end 810 and an open end 812. A second portion 804 includes a closed end 816 and an open end 814. The first portion 802 is sized slightly larger than the second portion 804 such that the open end 814 of the second portion 804 can extend into an opening 902 in the open end 812 of the first portion 802. In a preferred form, the telescoping container 800 takes the form of a right triangular prism; however, various other container shapes are contemplated herein. This triangular shape, depicted at 906, has been discovered to be advantageous in that multiple telescoping containers 800 can be stacked to form a square shape, thereby reducing wasted space typically encountered shipping screen systems of the prior art. While it is contemplated that the container 800 can be formed of a variety of materials, in a preferred form, the container 800 is formed of a corrugated cardboard.

During use, a screen installation kit, such as installation kit 700 will be inserted within an interior cavity 904 of the second portion 804 of the container 800. The open end 812 of the first portion 802 is then placed over the installation kit 700, and is slid over the open end 814 of the second portion 804. One of the closed ends 810, 816, is then pushed toward the other of the closed ends 810, 816 until the installation kit 700 prevents the two portions 804, 802 from being slid together further. The intersection 806 between the first portion 802, and the second portion 804, can then be taped or fixed in another suitable fashion, and the container 800 shipped.

From the foregoing description, it will be recognized by those skilled in the art that a hidden fastener window screen installation system offering advantages over the prior art has been provided. Specifically, the hidden fastener window screen installation system is designed for releasably mounting a screen or other pliable sheet material in such a manner as to self-tighten the fabric or material during installation. Although mechanical fasteners are used to mount the screen frame to the structure in a semi-permanent manner, the trim molds are configured to cover and effectively hide the fasteners from view. Moreover, the screen frame is designed to allow for the mounting of the fabric or material without damaging the same such that it may be removed and replaced (e.g. as may occur during initial installation).

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A hidden fastener screen installation system, comprising:

a plurality of screen frame extrusions cooperating to form an opening across which a screen is positioned, wherein each screen frame extrusion includes a mounting surface and a singular mounting rib extending upwardly from the mounting surface, wherein the sole protrusion extending upwardly from the mounting surface is the singular mounting rib, and wherein the mounting surface is configured to receive a plurality of mechanical fasteners to retain the screen frame extrusion to a portion of a building structure; and a trim mold defining a channel configured to closely receive and retain the mounting rib, wherein the screen is received in the channel and is retained by cooperation between the trim mold and the mounting rib, wherein the trim mold includes a substantially rectangular extension extending outwardly above a first end of the mounting surface, wherein the substantially rectangular extension includes a height greater than a height of the mounting rib, and wherein the substantially rectangular extension extends over the fasteners and fully covers the fasteners such that the fasteners are completely hidden upon installation of the trim mold on the screen frame.

2. The hidden fastener screen installation system of claim 1, wherein the mounting rib defines a bead along a terminus of the mounting rib, wherein the channel includes a plurality of retention barbs configured to engage the bead, and wherein the screen is self-tightened as the trim mold is engaged with the screen frame extrusion.

3. The hidden fastener screen installation system of claim 2, wherein the channel includes a depth substantially equal to a height of the mounting rib.

4. The hidden fastener screen installation system of claim 3, wherein the mounting rib extends in a direction that is substantially perpendicular to the mounting surface.

5. The hidden fastener screen installation system of claim 2, wherein the bead and the fasteners fail to penetrate the screen.

6. The hidden fastener screen installation system of claim 1, wherein the trim mold has a width approximately equal to a width of the mounting surface.

7. The hidden fastener screen installation system of claim 1, wherein the trim mold further includes a hollow cavity in the substantially rectangular extension.

8. The hidden fastener screen installation system of claim 1, wherein the screen frame extrusion substantially comprises a T-shape.

9. A screen installation system, comprising:

a plurality of screen frame extrusions cooperating to form an opening across which a screen is retained, wherein each screen frame extrusion is attached to a building structure through a plurality of fasteners extending through a mounting surface of the screen frame extrusion;

a singular mounting rib extending outwardly from the mounting surface of the screen frame extrusion, wherein the mounting rib is substantially perpendicular relative the mounting surface, wherein the mounting rib comprises the only protrusion extending outwardly from the mounting surface, wherein the mounting rib divides the mounting surface into a first side located toward the opening and a second side located away from the opening, wherein the plurality of fasteners extend through the first side of the mounting surface, and wherein the second side of the mounting surface is free of fasteners;

a bead located at a terminus of the mounting rib, wherein the mounting surface, the mounting rib, and the bead comprise a unitary extrusion;

a trim mold extrusion having a channel configured to closely receive and retain the mounting rib, wherein the channel further defines a plurality of retention barbs structured to engage the bead, and wherein the screen is received within the channel and is retained between the trim mold and the mounting rib; and wherein an outwardly protruding extension of the trim mold extends over the fasteners such that the fasteners are fully covered and concealed by the installation of the trim mold on the screen frame.

10. The screen installation system of claim 9, wherein the trim mold comprises a polymer extrusion, wherein the screen frame comprises an aluminum extrusion, wherein the first side of the mounting surface includes a plurality of apertures configured to receive the fasteners.

11. The screen installation system of claim 9, wherein the trim mold has a width approximately equal to a width of the mounting surface, and wherein the channel includes a depth substantially equal to a height of the mounting rib.

12. The screen installation system of claim 9, wherein the outwardly protruding extension of the trim mold is a substantially rectangular extension extending outwardly above a first end of the mounting surface, wherein the substantially rectangular extension includes a height greater than a height of the mounting rib, and wherein the substantially rectangular extension fully extends over, and conceals, the fasteners.

13. The screen installation system of claim 12, wherein the substantially rectangular extension at least partially defines a hollow cavity.

14. The screen installation system of claim 9, wherein the screen frame extrusion substantially comprises a T-shape.

15. The screen installation system of claim 9, wherein the screen is self-tightened as the trim mold is engaged with the screen frame extrusion.

16. A hidden fastener screen installation kit, comprising:

a screen mesh;

a plurality of screen frame extrusions configured to define an opening across which the screen mesh is to be positioned, wherein each screen frame extrusion includes a mounting surface and a singular mounting rib extending perpendicularly outward relative the mounting surface, wherein the singular mounting rib is the sole protrusion extending outwardly from the mounting surface, and wherein the mounting surface is configured to receive a plurality of mechanical fasteners to retain the screen frame extrusion to a building structure;

a plurality of trim molds, wherein each trim mold includes a channel configured to closely receive and retain the mounting rib, wherein the screen is received between the mounting rib and the trim mold within the channel and is retained therein by cooperation between the mounting rib and the trim mold; and wherein each trim mold is asymmetric relative a vertical axis extending thorough a midpoint of the channel, wherein an outwardly protruding extension of the trim mold extends over, and fully covers, the plurality of mechanical fasteners when the mounting rib is engaged by the trim mold.

17. The hidden fastener screen installation kit of claim 16, further comprising a shipping container, wherein the shipping container comprises a telescoping triangular prism.

18. The hidden fastener screen installation kit of claim 17, wherein the outwardly protruding extension comprises one of a substantially rectangular extension extending outwardly above a first end of the mounting surface and a tapered extension extending outwardly toward a first end of the mounting surface.

19. The hidden fastener screen installation kit of claim 18, wherein the kit further includes a plurality of corner plinths, wherein the plurality of fasteners further comprises a plurality of screws, wherein each of the plurality of screen frame extrusions comprises a unitary aluminum extrusion substantially defining a T-shape, and wherein the trim mold further comprises a polymer extrusion.

* * * * *